US006533642B1

(12) United States Patent
Dyer

(10) Patent No.: US 6,533,642 B1
(45) Date of Patent: Mar. 18, 2003

(54) ELECTRONIC CONTROL SYSTEM BY PLANER/SANDER

(75) Inventor: Ben K. Dyer, Whitesburg, TN (US)

(73) Assignee: Cemco, Inc., Whitesburg, TN (US)

( * ) Notice: Subject to any disclaimer, the term of this patent is extended or adjusted under 35 U.S.C. 154(b) by 41 days.

(21) Appl. No.: 09/924,931

(22) Filed: Aug. 8, 2001

Related U.S. Application Data

(60) Provisional application No. 60/224,186, filed on Aug. 9, 2000.

(51) Int. Cl.[7] ..... B24B 49/00

(52) U.S. Cl. ..... 451/8; 451/10; 451/11; 451/5; 144/357; 144/382; 144/117.1; 144/130

(58) Field of Search ..... 451/8, 9, 10, 11, 451/5, 6, 21, 182, 184, 297, 299, 300, 303, 311; 144/357, 382, 402, 117.1, 130, 114.1

(56) References Cited

U.S. PATENT DOCUMENTS 3,676,652 A 7/1972 Millis, Jr. et al.
4,436,126 A 3/1984 Lawson
4,461,124 A 7/1984 Anderson
4,513,539 A * 4/1985 Steinback ..... 451/300
4,742,650 A 5/1988 Sauder, Jr. et al.
4,864,775 A 9/1989 David
5,077,941 A 1/1992 Whitney
5,085,008 A * 2/1992 Jennings et al. ..... 451/184
5,117,366 A 5/1992 Stong
RE34,014 E 8/1992 Hundebol
5,156,257 A 10/1992 Hundebl
5,184,424 A 2/1993 Miller
5,396,938 A 3/1995 Cannaday
5,794,675 A 8/1998 Garcia
6,089,958 A * 7/2000 Costa et al. ..... 451/59
6,299,512 B1 * 10/2001 Costa et al. ..... 451/59
6,342,000 B1 * 1/2002 Yan ..... 451/304

* cited by examiner

*Primary Examiner*—George Nguyen
*Assistant Examiner*—Dung Van Nguyen
(74) *Attorney, Agent, or Firm*—Smith, Gambrell & Russell, LLP

(57) ABSTRACT

An electronic control system for a planing or sanding machine is disclosed. The system uses twin linear measuring devices and twin motor-driven drive-systems, integrated by a computer or other electronic device, to independently monitor and control the position of each end of the planing or sanding head.

17 Claims, 2 Drawing Sheets

ELECTRONIC CONTROL SYSTEM BY PLANER/SANDER

This non-provisional patent application claims benefit of the provisional patent application entitled "Electronic Control System for Planer/Sander", having Serial No. 60/224,186, and that was filed on Aug. 9, 2000.

FIELD OF THE INVENTION

The present invention relates to an electronic control system for a planing or sanding machine. More particularly, the invention relates to a control system using independent measurement and control of the position of each end of the planing or sanding head of the machine, so as to produce a machine capable of planing or sanding a board or panel with minimum deviation in thickness across the width of the piece.

BACKGROUND OF THE INVENTION

Planing or sanding machines are widely used in a number of industries, including the furniture and construction industries. These machines can produce boards or panels of material, most typically wood, with a uniform thickness and a smooth surface, which may then be utilized directly or further processed to produce a wide variety of useful products. In many of these applications, the thickness of the resulting material must be maintained within exacting tolerances over the entire board or panel being machined.

In a fully automated or semi-automated manufacturing process, the sanding or planing thickness must be readily and quickly adjustable, so that boards and panels of various dimensions can be accommodated without interrupting the flow of production. While manually adjustable machines have been used in the past, these systems are unsuitable for high-volume applications. The height of the sanding or planing head (corresponding to the thickness of the resulting board or panel) is therefore often adjusted via an electronic system utilizing a computer, microprocessor or similar device to control an electric motor, which can then reposition the head using a system of gears and drive shafts. Instantaneous electronic control over the position of the planing or sanding head is thereby established, and in a multi-step manufacturing process can be integrated into a computer system which monitors and controls the entire process.

Unfortunately, mechanical imperfections in the drive train connecting the motor with the planing or sanding head can lead to disparities between the intended position of the sanding or planing head and its actual position. Backlash, slack, and wear in the gear system is a common cause of such problems. Because of the tolerances required in some applications, even minor inaccuracies in head positioning and board thickness are sometimes unacceptable.

In an attempt to resolve this problem, planing or sanding machine manufacturers have developed systems designed to monitor and correct the actual position of the planing or sanding head. In the typical system, an electronic linear measuring device is used to track the position of the planing or sanding head with a high degree of precision. This information is fed into a central processing unit, microprocessor, or similar electronic device, which then provides an electric motor with the instructions necessary to maintain the desired head position with respect to the item being processed.

In the systems of this type in use to date, however, a problem arises because a single control system is used to control the movement of the planing or sanding head across its entire width. Typically, the linear measuring device and motor are positioned at one end of the head, and the other end is linked to the motor via a connecting shaft and gearing arrangement. Both ends of the planing or sanding head therefore track together.

However, in actual operation this system may result in substantial disparities in thickness across the width of the board or panel being machined. These disparities are caused by natural limitations in the accuracy with which the movements prescribed by the control system on one end of the planing or sanding head are conveyed by gears and shafts to the other. The resulting inaccuracies may be substantial enough to cause unacceptable deviations in the thickness of the resulting machined product.

What is desired, then, and not found in the prior art, is a planing or sanding machine control system that will take account of these problems, and produce a precise and uniform thickness across the entire width of the board or panel being processed.

SUMMARY OF THE INVENTION

It is the primary object of the present invention to provide an electronic control system for a planing or sanding machine that is capable of maintaining a uniform thickness across the entire width of the board or panel being processed. In the improved system disclosed herein, dual and independent control of the two ends of the machine's planing or sanding head is established. A linear measuring device and motor-driven drive unit is positioned at either end of the head, and linked via a computer, microprocessor or similar electronic device to provide separate control of the movement of each end of the head.

DESCRIPTION OF THE PREFERRED EMBODIMENTS

Figure 1:
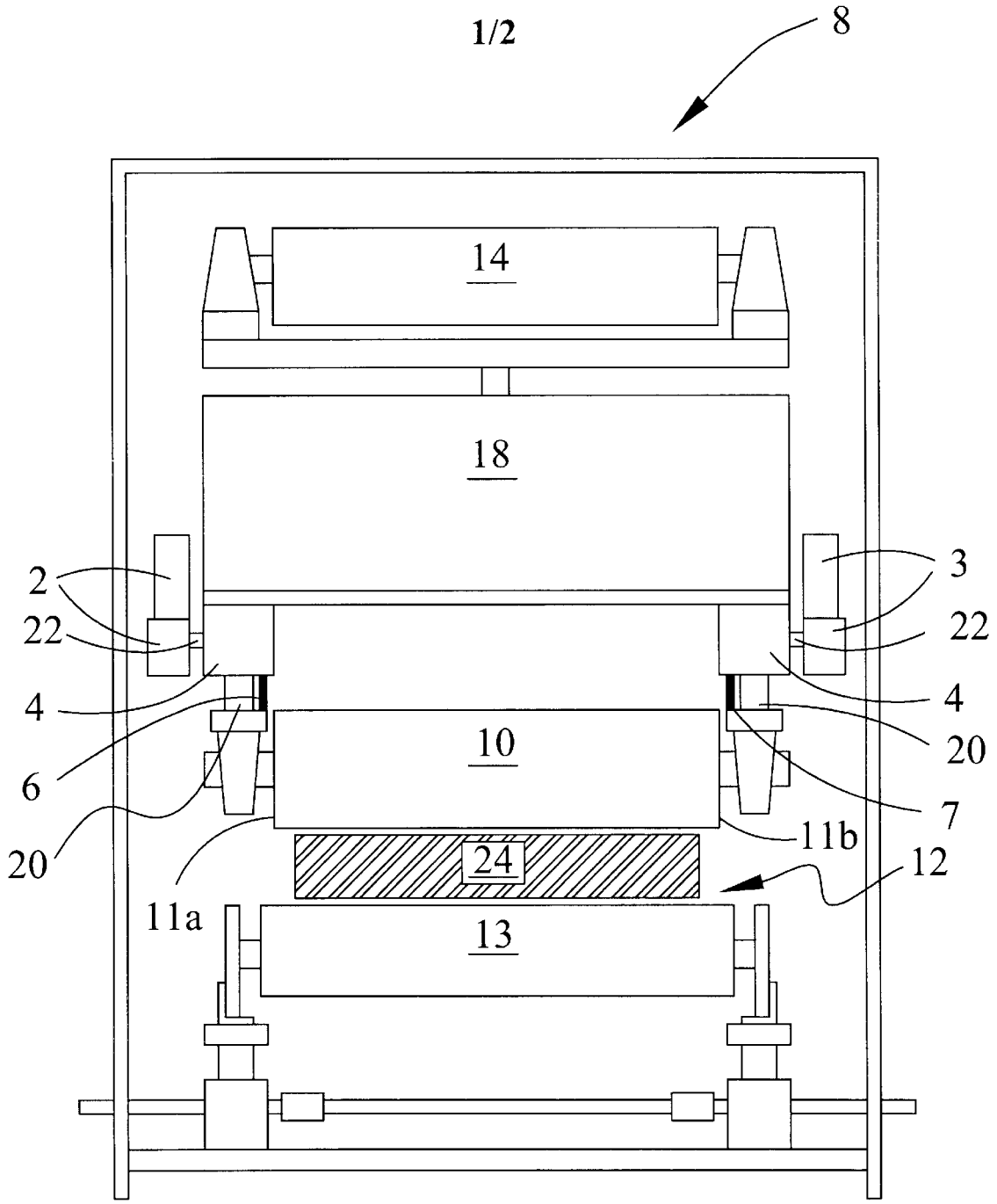
FIG. 1 is a front view of a planing or sanding machine utilizing a control system as described herein.
Figure 2:
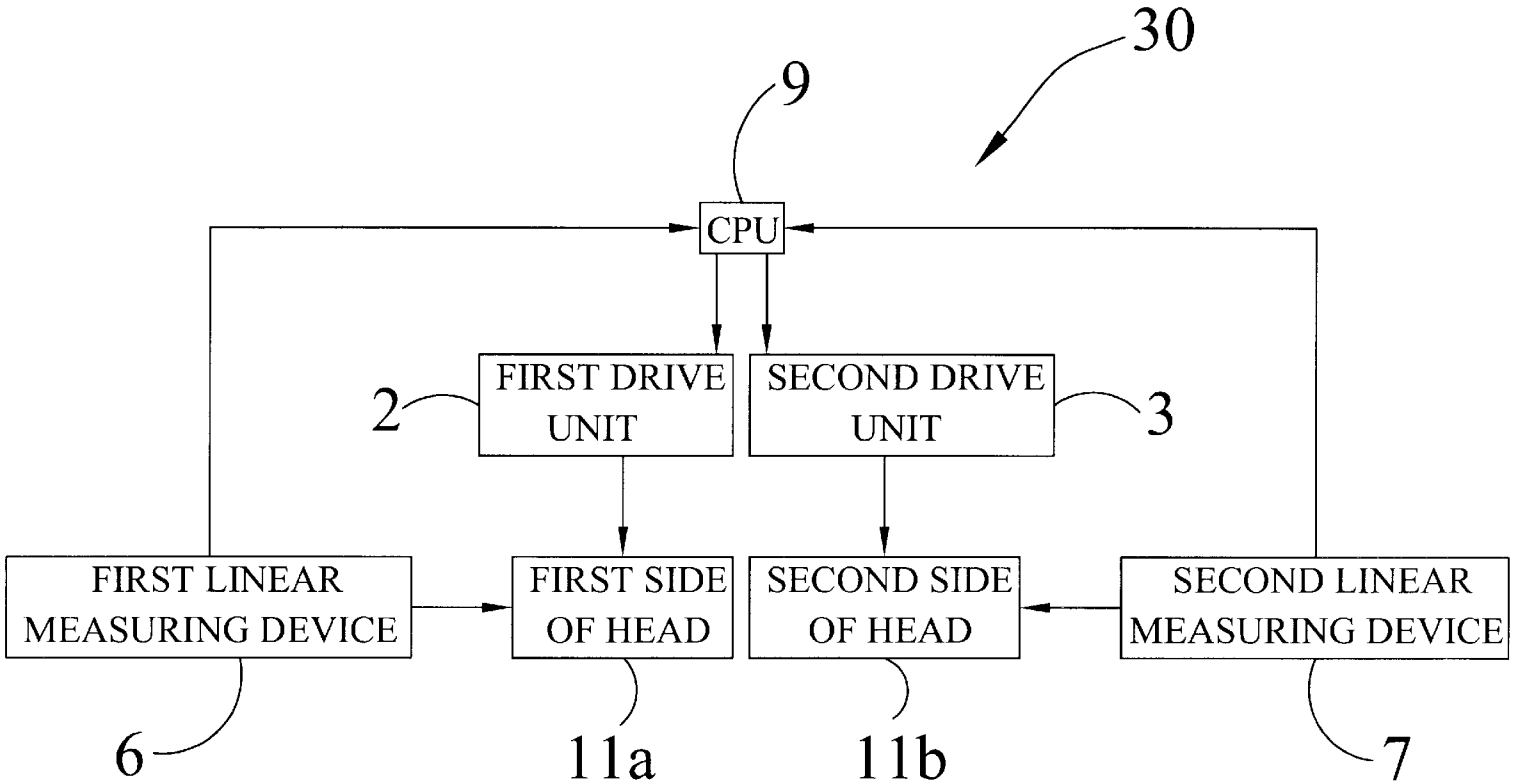
FIG. 2 is a block diagram of the control system of the planing or sanding machine of the present invention.

FIG. 1 illustrates a planing or sanding machine 8 of typical design, utilizing a control system 30 is illustrated in FIG. 2 and described herein. As shown, the preferred embodiment of the sanding machine 8 typically utilizes a conveyor system 12 as a support surface for a rough planar material 24, such as a board or panel. The conveyor system 12 may incorporate a series of chain-driven rollers 13 and a conveyor belt or similar means to move the planar material 24 through the machine 8 at a controlled pace. Suspended above the conveyor system 12 is a planing or sanding head 10, which acts on the planar material 24 to reduce its thickness and/or smooth its upper surface. In a familiar arrangement, this planing or sanding head 10 may be driven via a belt (not illustrated) which is also arrayed around a belt idler 14 and the main beam 18 of the machine 10. This arrangement will provide the mechanical action for the planing or sanding head 10 required to plane or sand the planar material 24.

Looking to the block diagram of FIG. 2, the control system 30 of a preferred embodiment is utilized to maintain the position of the head 10 at a uniform and fixed distance from the conveyor 12, despite any backlash, slack, or wear which may occur. The control system 30 includes two linear measuring devices 6, 7 that are used to monitor the vertical position of each end 11*a*, 11*b* of the head 10. More specifically, referring back to FIG. 1, the first linear measuring device 6 is used to measure the vertical position of the first end 11*a* of the head 10, and the second linear measuring device 7 is used to measure the vertical position of the second end 11*b* of the head 10.

Looking to FIG. 2, the linear measuring devices 6, 7 are additionally connected to a central processing unit 9 or other electronic device. Consequently, the linear measuring devices 6, 7 will provide the respective positioning information to the central processing unit 9 as required. The central processing unit 9 can then utilize the feedback from the linear measuring devices 6, 7 to independently control the two motor-driven drive units 2, 3 that are connected to the first end 11*a* and the second end 11*b* of the sanding head 10 respectively. The motor-driven drive units 2, 3 will thereby generate any necessary corrections through connecting shafts 22 to gear boxes 4 and via additional shafts 20 connected to the sanding head 10 itself. Consequently, unlike prior designs for controlling the sanding of the planar material 24, the complete width of the head 10 in the present invention is maintained at a uniform distance from the conveyor 12 across its entire width. Since the head 10 is uniform, the machine 8 will producing a planed or sanded planar material 24 of uniform thickness.

Thus, although there have been described particular embodiments of the present invention of a new and useful ELECTRONIC CONTROL SYSTEM FOR PLANER/SANDER, it is not intended that such references be construed as limitations upon the scope of this invention except as set forth in the following claims.

What is claimed is:

1. An assembly for evenly processing a planar material comprising:

a support surface for holding the planar material;

a vertically adjustable processing member positioned above said support surface, said processing member having a first end and a second end;

a first sensor to monitor the position of said first end of said processing member;

a second sensor to monitor the position said second end of said processing member; and means for uniformly positioning said processing member proximate to the planar material, said positioning means connected to said first sensor and second sensor.

2. The assembly as described in claim 1 wherein said support surface comprises a conveyor system including a plurality of conveyor rollers.

3. The assembly as described in claim 1 wherein said processing member comprises a sanding head.

4. The assembly as described in claim 1 wherein said processing member comprises a planing head.

5. The assembly as described in claim 1 wherein said first sensor is a linear measuring device to assess the vertical position of said first end of said processing member above said support surface.

6. The assembly as described in claim 1 wherein said second sensor is a linear measuring device to assess the vertical position of said second end of said processing member above said support surface.

7. The assembly as described in claim 1 wherein said positioning means comprises a central processing unit.

8. The assembly as described in claim 7 wherein said positioning means further comprises a first drive unit connected between said central processing unit and said first end of said processing member to control the vertical position of said first end of said processing member.

9. The assembly as described in claim 7 wherein said processing means further comprises a second drive unit connected between said central processing unit and said second end of said processing member to control the vertical position of said second end of said processing member.

10. An apparatus for uniformly smoothing a panel comprising:

a support surface for holding the panel;

a processing member movably positioned above said support surface such that the panel is positioned between said support surface and said processing member, said processing member having a first end and a second end;

means for independently controlling the vertical position of said first end and said second end of said processing member; and means for monitoring the vertical position of said first end and said second end of said processing member, said monitoring means connected to said controlling means to manage said controlling means.

11. The apparatus as described in claim 10 wherein said support surface comprises at least two driven rollers.

12. The apparatus as described in claim 10 wherein said processing member comprises a driven sanding head.

13. The apparatus as described in claim 10 wherein said processing member comprises a driven planing head.

14. The apparatus as described in claim 10 wherein said monitoring means comprises a first sensor.

15. The apparatus as described in claim 10 wherein said monitoring means comprises a second sensor.

16. The apparatus as described in claim 10 wherein said controlling means comprises:

a central processing unit;

a first drive unit connected between said central processing unit and said first end of said processing member; and a second drive unit connected between said central processing unit and said second end of said processing member.

17. A method for uniformly processing a planar material comprising the steps of:

providing a processing member having a first end and a second end adjustably positioned proximate a support surface;

moving the planar material on said support surface between said support surface and said processing member;

monitoring the vertical position of said first end of said processing member with a first sensor;

monitoring the vertical position of said second end of said processing member with a second sensor;

providing a first signal from said first sensor to a central processing unit;

providing a second signal from said second sensor to said central processing unit;

managing the operation of a first drive unit connected to said first end of said processing member using said central processing unit;

managing the operation of a second drive unit connected to said second end of said processing member using said central processing unit;

independently varying the position of said first end of said processing member with said first drive unit and said second end of said processing member with said second drive unit to uniformly position said processing member in relation to the planar material.

* * * * *